United States Patent [19]

Mouri

[11] 4,450,815

[45] May 29, 1984

[54] INTERNAL COMBUSTION ENGINE CONTROL APPARATUS

[75] Inventor: Yasunori Mouri, Katsuta, Japan

[73] Assignee: Hitachi, Ltd., Tokyo, Japan

[21] Appl. No.: 374,872

[22] Filed: May 4, 1982

[30] Foreign Application Priority Data

May 6, 1981 [JP] Japan ..... 56-66952

[51] Int. Cl.[3] ..... F02D 37/02

[52] U.S. Cl. ..... 123/479; 123/416; 123/483; 123/494

[58] Field of Search ..... 123/479, 494, 483, 198 D, 123/415, 416, 417; 364/431.11

[56] References Cited

U.S. PATENT DOCUMENTS 3,834,361 9/1974 Keely ..... 123/479
3,911,872 10/1975 Hughes ..... 123/494
4,245,315 1/1981 Barman et al. ..... 364/431.11
4,317,437 3/1982 Lindgren ..... 123/416
4,370,962 2/1983 Hasaka ..... 123/479

FOREIGN PATENT DOCUMENTS 55-49546 4/1980 Japan ..... 123/479
55-148925 11/1980 Japan ..... 123/479

*Primary Examiner*—Andrew M. Dolinar
*Attorney, Agent, or Firm*—Antonelli, Terry & Wands

[57] ABSTRACT

An internal combustion engine control apparatus comprises sensors for sensing operation parameters of an internal combustion engine, a control unit for controlling the operation of the internal combustion engine based on the operation parameters sensed by the sensors, and a control circuit operative, when one of the sensors or the control unit fails, to generate one of predetermined signals indicating a plurality of predetermined operation conditions in accordance with a current operation condition to continue the operation of the internal combustion engine in accordance with the generated predetermined signal.

13 Claims, 18 Drawing Figures

INTERNAL COMBUSTION ENGINE CONTROL APPARATUS

The present invention relates to an internal combustion engine control apparatus, and more particularly to an internal combustion engine control apparatus which backs up a failure of a sensor for sensing an operation parameter of an internal combustion engine or a controller for controlling the internal combustion engine based on the sensed operation parameter.

As the concerns to the security of environment by the prevention of air pollution and the shortage of energy resources increases, a control apparatus which totally controls an operation condition of an automobile gasoline engine to improve an exhaust gas condition and fuel consumption is desired to this end, an electronic engine control apparatus (EEC) having a microcomputer which reads in signals from sensors which supply various data indicating operation conditions of the engine, such as an intake air sensor which senses the amount of air taken into the engine, a coolant temperature sensor and an oxygen sensor which senses a concentration of oxygen in exhaust gas to control various factors such as the amount of fuel supply, an ignition timing, the amount of reflux of the exhaust gas and an idling rotation speed, has been widely used. As a result, almost all controls required for the engine including an air to fuel ratio (A/F) control are totally controlled to an optimum condition to provide an engine which satisfies a severe regulation for the exhaust gas and improves the fuel consumption.

On the other hand, such an EEC has a short history and the reliability of the microcomputer and the sensors used therein is unknown in many aspects. Accordingly, much attention should be paid to the loss of control function of the EEC due to failures of those elements.

On the other hand, in the automobile engine, if an engine stall takes place due to the loss of control function of the EEC, it leads to a road trouble of the automobile and a dangerous condition preventing stable running of the automobile. Accordingly, a system which prevents the engine stall under such a condition is desired.

A basic function in a computer control is the detection of various status data of the automobile. Among others, a hot wire sensor plays an important role in controlling the amount of fuel injection. The hot wire sensor has a function to automatically sense the amount of intake air which is cleaned by an air cleaner and taken into a throttle chamber. The amount of intake air may be sensed in the throttle chamber or in a bypass passage. The amount of fuel injection from a fuel injector is calculated by the computer based on the amount of intake air sensed by the hot wire sensor and other related status data. The injector is controlled by the calculated amount of fuel injection. Because the amount of fuel injection depends on an actuation time period of the injector, the control signal is given in form of injector actuation time.

The control of the amount of fuel injection is valid on the condition that the hot wire sensor operates properly. If the hot wire sensor fails, the amount of fuel injection is no longer valid and the fuel control is impossible to attain. If the computer fails for some reason or other, the calculated value is not valid or no output is produced, resulting in a similar condition. The ignition timing control cannot attain a correct control by a similar reason. In addition, $SO_x$ content or CO content in the exhaust gas increases.

An EEC has been proposed which has a backup control system to succeed the control to the engine when the microcomputer or the sensor fails in order to prevent the engine stall. For example, U.S. Pat. No. 4,099,495 discloses a system having separate control signal generating means which is independent from the microcomputer controlled EEC to control an engine ignition system and a fuel injection system by control signals from the control signal generating means when the backup thereby is required so that the engine operating condition is kept to prevent at least the engine stall. It also discloses to fix the ignition timing to a reference crank angle sensed by an angle sensor when the control system fails.

However, in the prior art backup system, since the separate and independent control signal generating means which is not inherently necessary to the EEC is required, a cost increases and the number of elements increases. As a result, the failure of the backup system per se is not negligible and hence a sufficient degree of reliability is not expected.

It is an object of the present invention to provide an internal combustion engine control apparatus which backs up a failure of a sensor for sensing an operation parameter of an internal combustion engine or a controller for controlling the internal combustion engine based on the sensed operation parameter.

It is another object of the present invention to provide an internal combustion engine control apparatus which provides an operation condition complied with an engine operation condition when such failure takes place.

It is a further object of the present invention to provide an internal combustion engine control apparatus controlled by a computer in a fail-safe mode which effects fuel control based on an actual operation condition when a hot wire sensor or the computer fails to prevent overrun of a fuel control system and to avoid fixing of the amount of fuel injection to a constant amount.

According to a feature of the present invention, when the hot wire sensor or the computer fails, the amount of fuel injection is determined by a throttle valve aperture sensed by a throttle valve aperture sensor instead of the output from the hot wire sensor to actuate the injector in accordance with the determined amount to control the fuel injection.

The above and other objects and features of the present invention will be apparent from the following description of the invention taken in conjunction with the accompanying drawings, in which.

Figure 4:
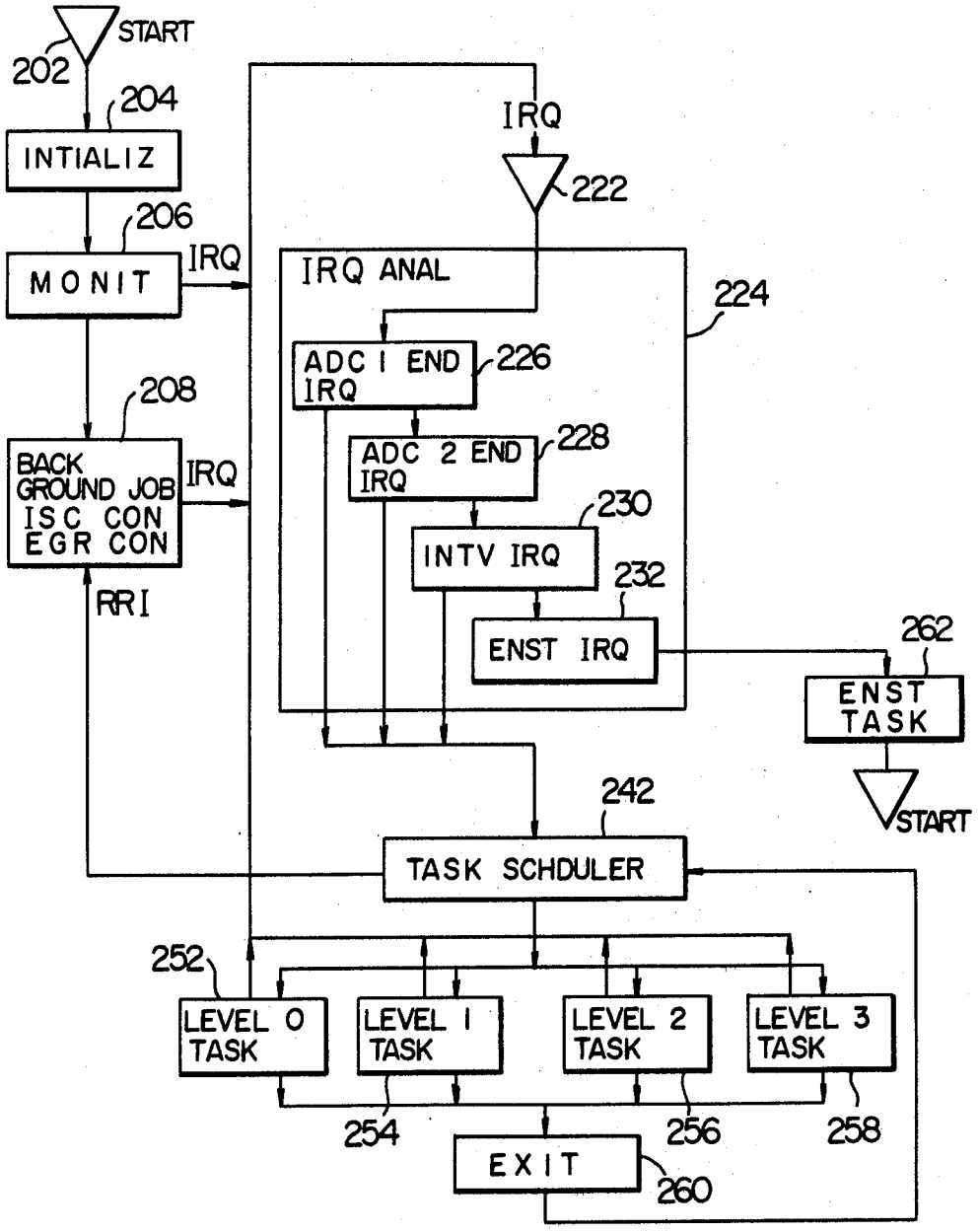
FIG. 4 shows an overall process flow chart.
Figure 7:
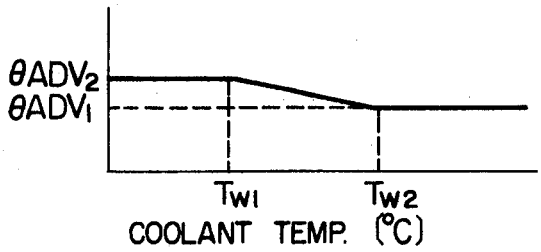
Figure 8:
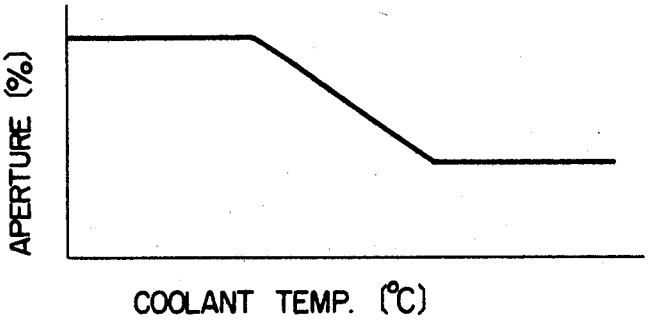
Figure 9:
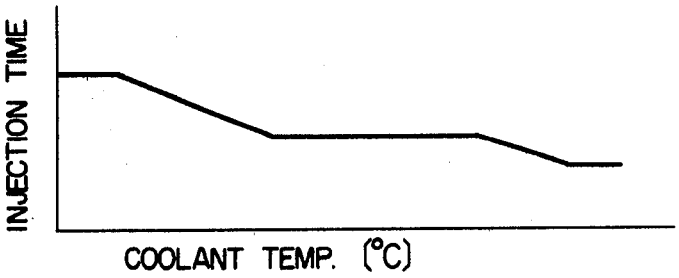
Figure 10:
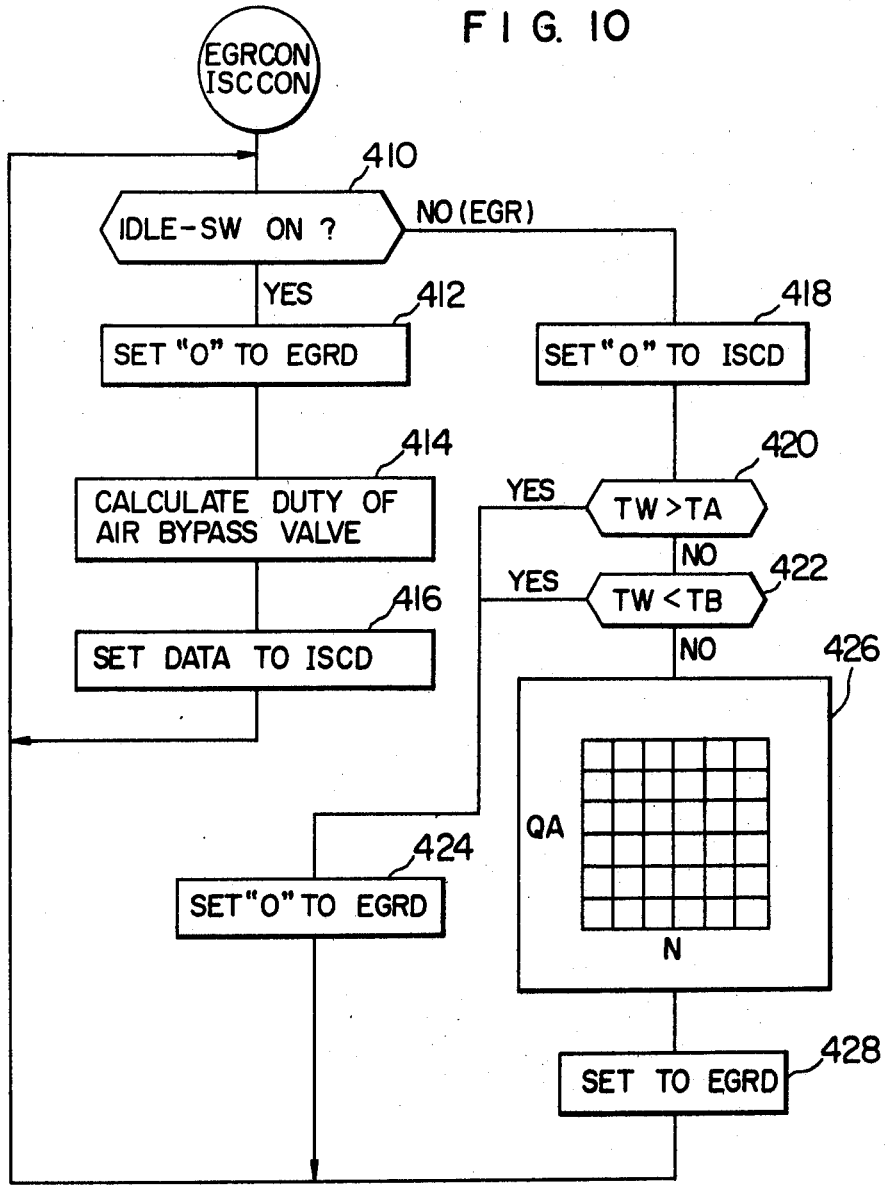
Figure 11:
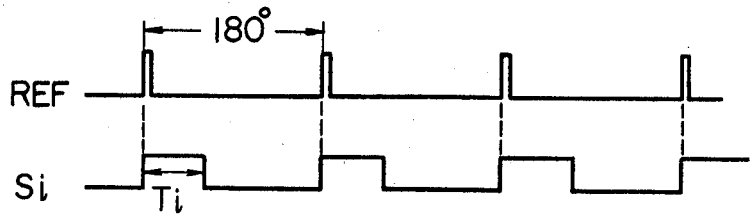
Figure 12:
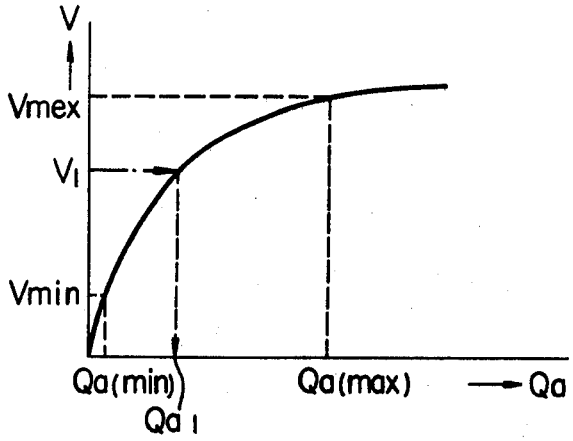
Figure 13:
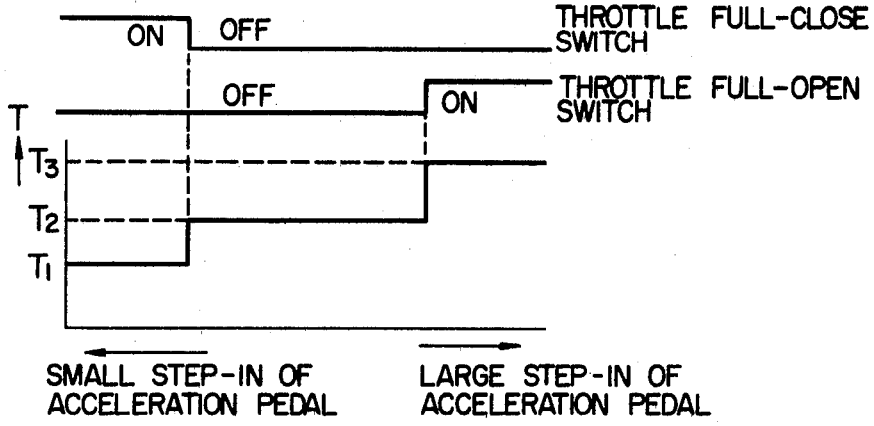
Figure 14:
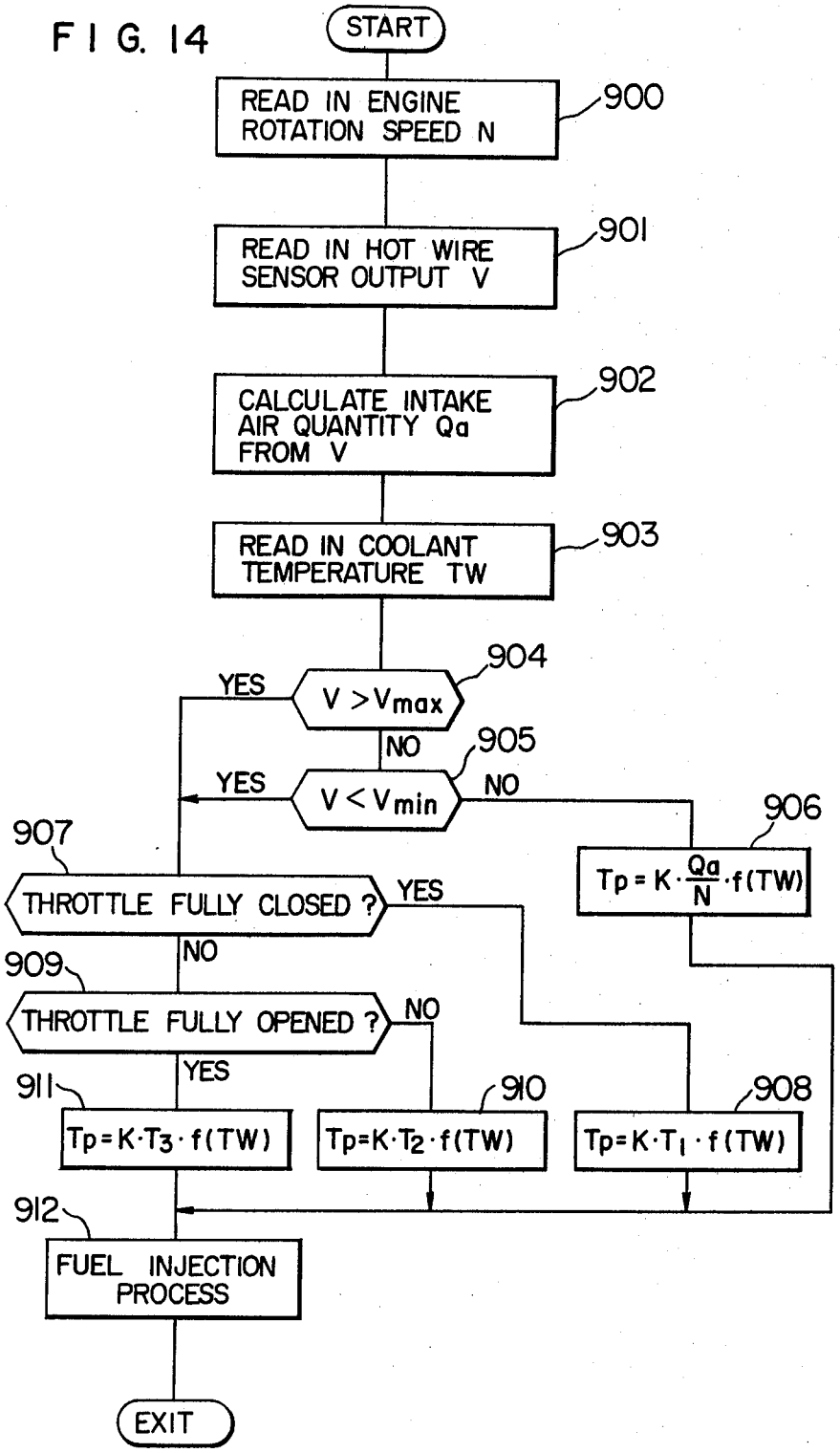
Figure 15:
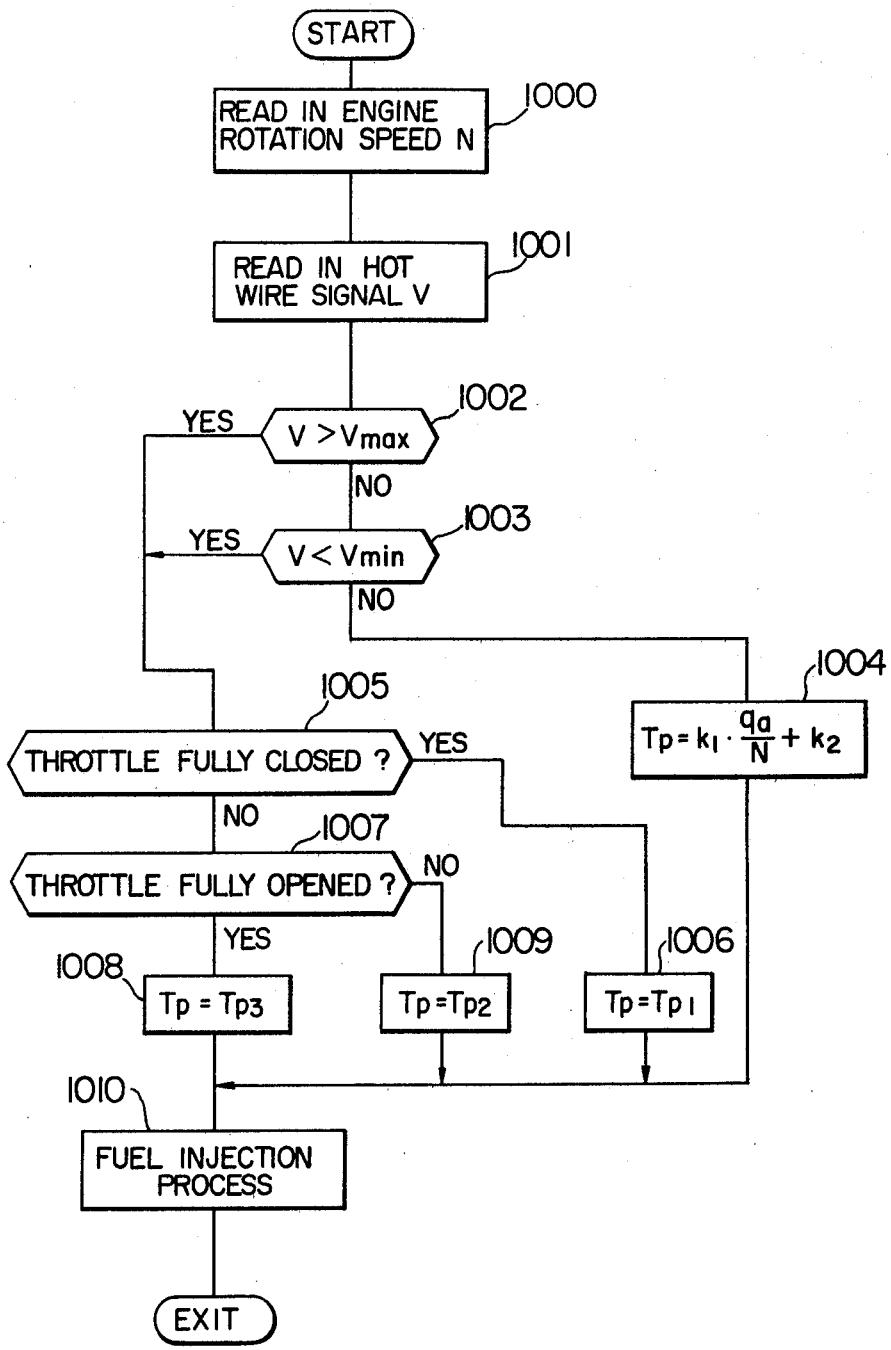
Figure 16:
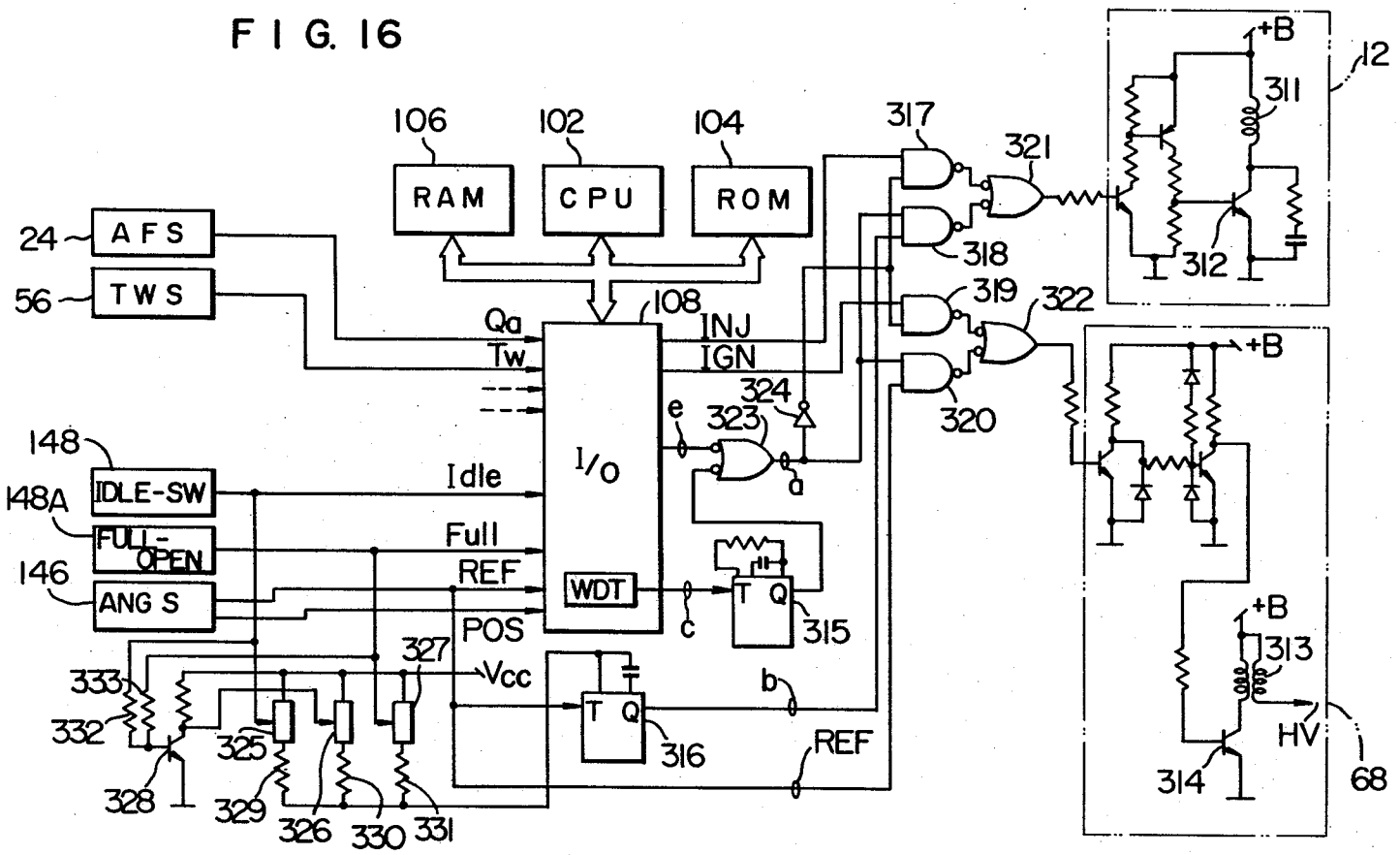
Figure 17:
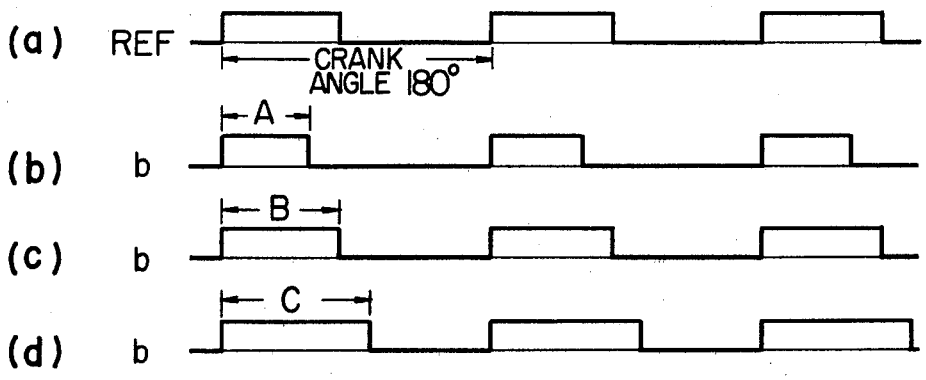
Figure 18:
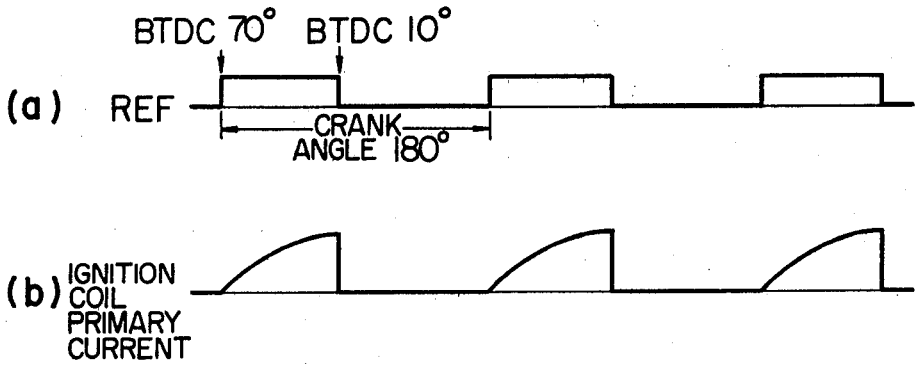

FIGS. 7, 8 and 9 show characteristic charts, FIG. 10 shows a partial process flow chart of FIG. 4, FIG. 11 shows a time chart, FIG. 12 shows a characteristic of a hot wire sensor, FIG. 13 illustrates an operation of one embodiment, FIG. 14 shows a process flow chart of one embodiment of the present invention, FIG. 15 shows a process flow chart of other embodiment of the present invention, FIG. 16 shows a configuration of a control apparatus of other embodiment of the present invention, FIG. 17 shows waveforms for explaining an operation of a fuel injector in a backup control mode, and FIG. 18 shows waveforms for explaining an operation of an ignition coil in the backup control mode.

The present invention is now explained in detail with reference to the accompanying drawings.

Figure 1:
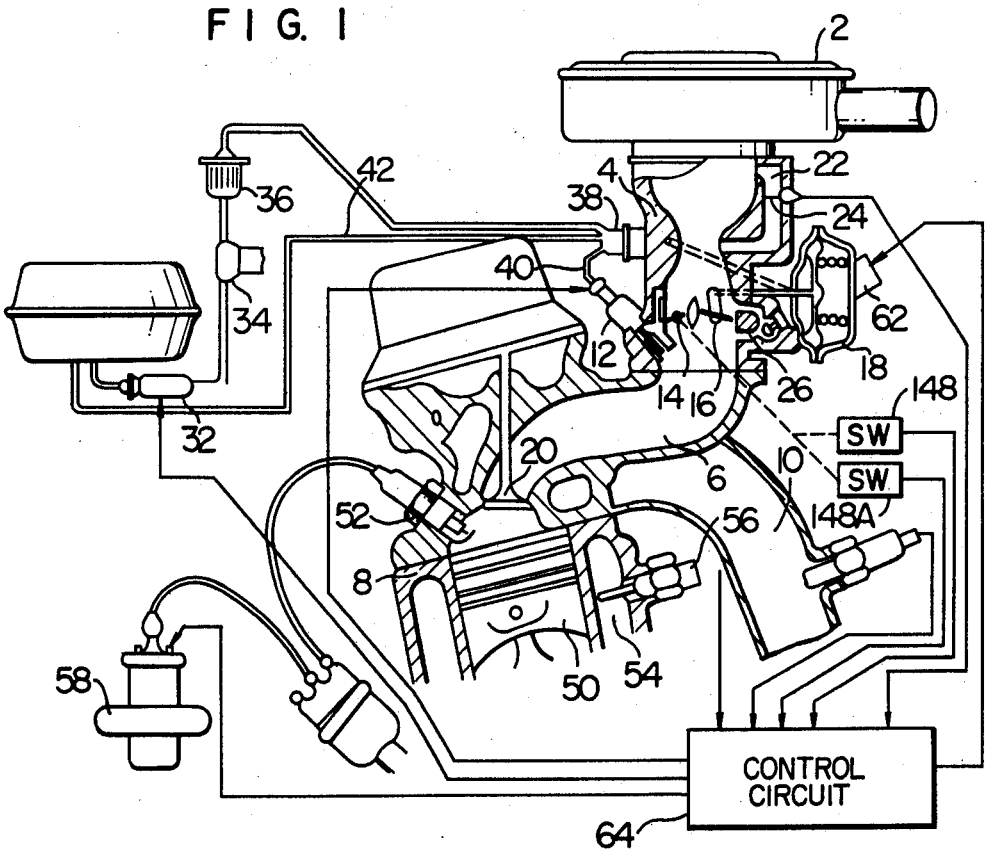
FIG. 1 shows a construction of an engine system.

FIG. 1 shows a control apparatus for an engine system. Intake air is supplied to cylinders 8 through an air cleaner 2, a throttle chamber 4 and an intake manifold 6. Gas from the cylinders 8 is exhausted to the air through an exhaust pipe 10.

The throttle chamber 4 has an injector 12 to inject fuel. The fuel injected from the injector 12 is atomized in an air passage of the throttle chamber 4 to form gas mixture with the intake air. The gas mixture is supplied to combustion chambers of the cylinders 8 through the intake manifold 6 when an intake valve 20 opens.

Throttle valves 14 and 16 are arranged around an exit of the injection 12. The throttle valve 14 is mechanically linked to an accelerator pedal which is driven by a driver. The throttle valve 16, on the other hand, is driven by a diaphragm 18 and fully closed in a small air flow rate region and opened as the air flow rate increases because of the increase of vacuum to the diaphragm, in order to suppress the increase of intake resistance.

A full-close switch 148 for sensing a fully closed condition of the throttle valve 14 and a fully-open switch 148A for sensing a fully opened condition of the throttle valve 14 are mounted in the throttle valve 14. Outputs from the switches 148 and 148A are supplied to a control circuit 64.

An air passage 22 is formed upstream of the throttle valves 14 and 16 of the throttle chamber 4 and a hot wire sensor 24 is arranged on the air passage 22 to provide an electrical signal which is determined by a relationship between an air flow rate and a heat conduction of a heating element and varies with the air flow rate. Since the hot wire sensor 24 is arranged in the air passage 22, it is protected from high temperature gas produced by backfire of the cylinders 8 and also protected from the contamination by dusts in the intake air. An exit of the air passage 22 is positioned in the vicinity of most contracted area of a venturi and an inlet is positioned upstream of the venturi.

Figure 2:
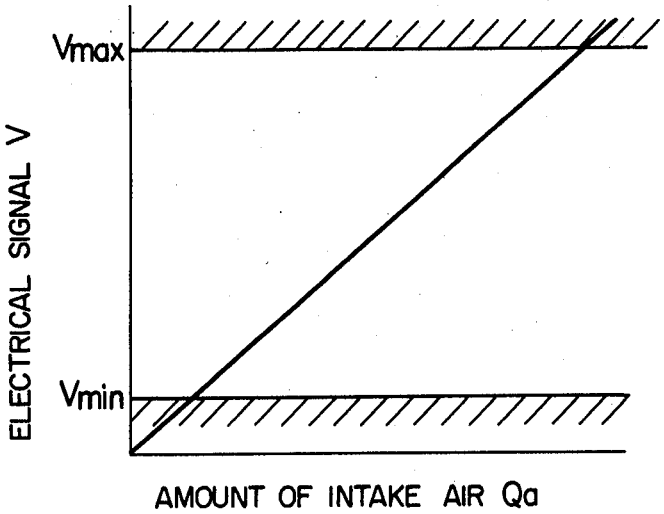
FIG. 2 shows a characteristic of a hot wire sensor.

In a normal operation condition of the engine, the amount of intake air is within a constant range and does not exceed a V max level nor fall below a Vmin level shown in FIG. 2. When the hot wire sensor 24 fails, breaks or shorts, the output thereof assumes an abnormal value and hence the electrical signal V exceeds the Vmax level or falls below the Vmin level. As a result, the failure is detected.

The fuel to be supplied to the injector 12 is supplied from a fuel tank 30 to a fuel pressure regulator 38 through a fuel pump 32, a fuel damper 34 and a filter 36. On the other hand, pressurized fuel is supplied from the fuel pressure regulator 38 to the injector 12 through a pipe 40 and the fuel is returned from the fuel pressure regulator 38 to the fuel tank 30 through a return pipe 42 such that a difference between a pressure of the intake manifold 6 to which the fuel is injected from the injector 12 and the fuel pressure to the injector 12 is kept constant.

The gas mixture taken in from the intake valve 20 is compressed by pistons 50 and burnt by sparks by ignition plugs 52, and the combustion is converted to a kinetic energy. The cylinders 8 are cooled by coolant 54 and a temperature of the coolant 54 is sensed by a water temperature sensor 56 to represent an engine temperature. High voltages are applied to the ignition plugs 52 by an ignition coil 58 in synchronism with the ignition timing.

A crank angle sensor for producing a reference angle signal at every reference crank angle and a position signal at a constant angular interval (e.g. 0.5 degree) as the engine rotates is mounted on a crank angle, not shown.

The output of the crank angle sensor, the output of the water temperature sensor 56 and the electrical signal from the hot wire sensor 24 are applied to the control circuit 64 which may be a microcomputer and processed by the control circuit 64. The injector 12 and the ignition coil 58 are driven by the outputs of the control circuit 64.

In the engine system controlled by the above-mentioned construction, a bypass 26 is formed in the throttle chamber 4 to communicate with the intake manifold 6 across the throttle valve 16. The bypass 26 is provided with a bypass valve 62. The control signal from the control circuit 64 is applied to an actuator of the bypass valve 62 to control the on-off state of the valve.

The bypass valve 62 faces to the bypass 26 which detours the throttle valve 16 and is opened and closed by a pulse current. The bypass valve 62 changes a sectional area of the bypass 26 by the amount of lift of the valve. The amount of lift is controlled by a drive system which is driven by the output of the control circuit 64. The control circuit 64 produces an on-off cycle signal for controlling the drive system which in turn responses to the on-off cycle signal to supply a control signal to a driver of the bypass valve 62 to control the amount of lift of the bypass valve 62.

The control circuit 64 may be a microcomputer which basically comprises a CPU and memories (RAM and ROM) and may include input/output devices although the definition of the input/output devices is vague. In the present embodiment, the input/output devices do not include the sensors and drive systems but can carry out not only input/output operations but also cretain processing operations for a mere purpose of definition.

Figure 3:
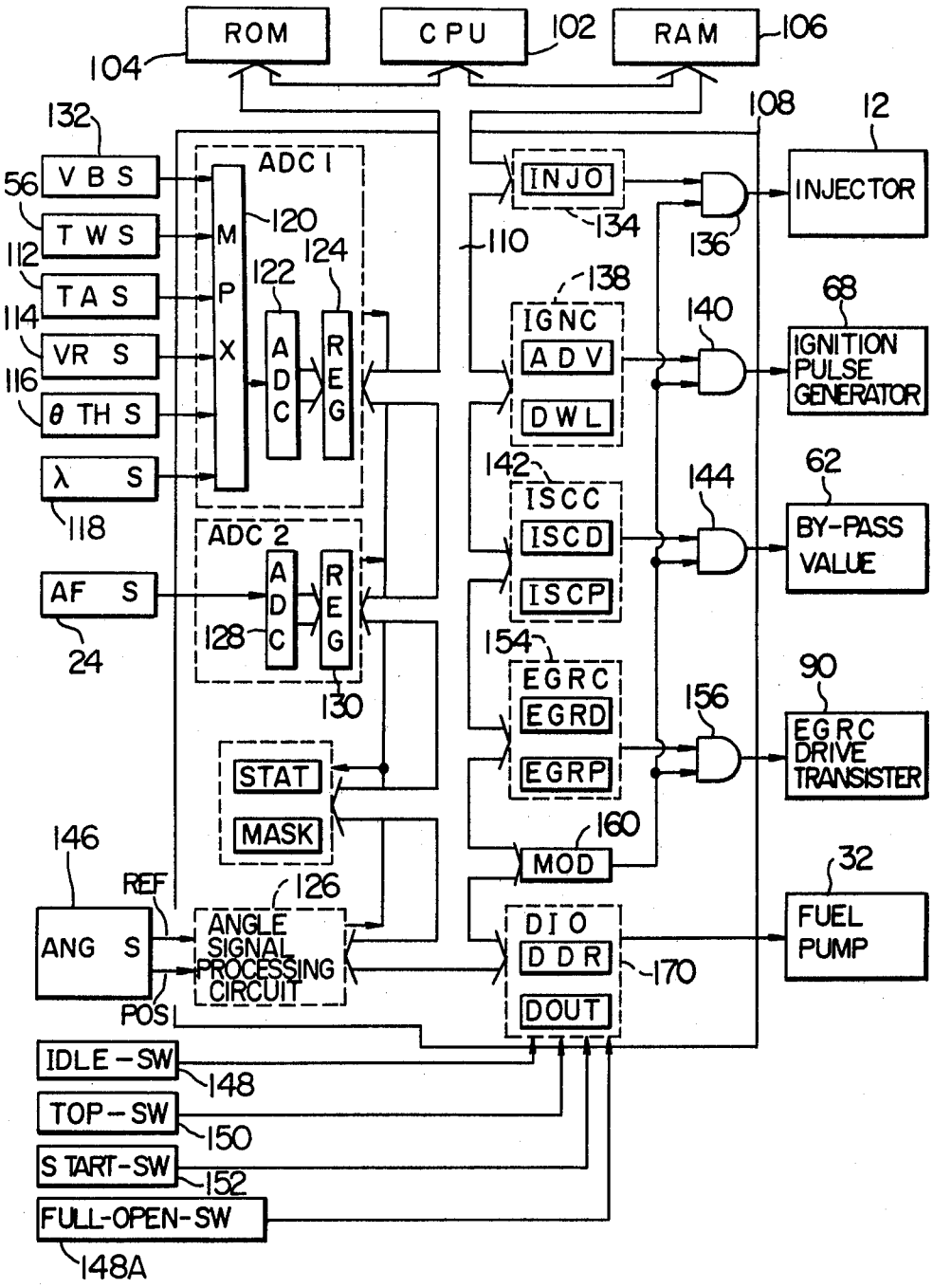
FIG. 3 shows a configuration of a control apparatus.

FIG. 3 shows an overall configuration of a control system. It comprises a CPU 102, a read-only memory (ROM) 104, a random access memory (RAM) 106 and an input/output circuit 108. The CPU 102 processes input data from the input/output circuit 108 under control of various programs stored in the ROM 104 and returns the results of the processing to the input/output circuit 108. The RAM 106 is used to temporarily store the data necessary for the processing. The data are exchanged among the CPU 102, the ROM 104, the RAM 106 and the input/output circuit 108 through a bus line 110 which comprises a data bus, a control bus and an address bus.

The input/output circuit 108 includes input means for a first analog-to-digital converter (ADC 1), a second analog-to-digital converter (ADC 2), an angle signal processing circuit 126 and a discrete input/output circuit (DIO) 170 for inputting and outputting one-bit information.

The first analog-to-digital circuit has a multiplexor (MPX) 120 to which outputs of a battery voltage sensor (VBS) 132, a water temperature sensor (VWS) 56, an atmosphere temperature sensor (TAS) 112, a regulated voltage generator (VRS) 114, a throttle angle sensor (OTHS) and a λ sensor (λS) 118 are applied and which selects out one of those outputs to an analog-to-digital converter circuit (ADC) 122. The digital value at the output of the analog-to-digital converter circuit 122 is stored in a register (REG) 124.

An output of the air flow rate sensor (AFS) 24 is applied to the second analog-to-digital converter which converts it to a digital signal by an analog-to-digital converter circuit 128, and the digital signal is stored in a register 130.

An angle sensor (ANGS) 146 produces a signal (REF) indicating a reference crank angle, for example, a 180-degree crank angle and a signal (POS) indicating a small crank angle, for example, one-degree crank angle are produced. Those signals are supplied to the angle signal processing circuit 126 and shaped thereby.

An idle switch (IDLE-SW) 148, a top gear switch TOP-SW) 150, a starter switch (START-SW) 152 and a full-open switch (FULL-OPEN-SW) 148A (which may also be called a power switch) are connected to the discrete input/output circuit 170.

A pulse output circuit operated based on the processing results of the CPU and control items thereof are now explained. An injector control circuit (INJC) 134 converts the digital values of the processing result to pulse width signals. Thus, the injector control circuit 134 produces a pulse signal having a pulse width corresponding to the amount of fuel injection, and the pulse signal is applied to the injector 12 through an AND gate 136.

An ignition pulse generating circuit (IGNC) 138 includes a register (ADV) for registering an ignition timing and a register (DWL) for registering a primary current conduction start time for an ignition coil. Those data are loaded to the registers from the CPU. The ignition pulse generating circuit 138 generates a pulse based on the loaded data and controls an ignition pulse generator 68 through an AND gate 140 to generate an ignition pulse.

An aperture of the bypass valve 62 is controlled by a pulse supplied from a control circuit (ISCC) 142 through an AND gate 144. The control circuit 142 has a register (ISCD) for registering a pulse width and a register (ISCP) for registering a pulse repetition period.

An EGR quantity control pulse generating circuit (EGRC) 154 for controlling an exhaust gas recirculation (EGR) control valve has a register (EGRD) for registering a duty factor of a pulse and a register EGRP) for registering a pulse repetition period. The output pulse of the exhaust gas recirculation quantity control pulse generating circuit 154 is supplied to a drive transistor 90 through an AND gate 156.

The one-bit input/output signal is controlled by the discrete input/output circuit 170. The input signal includes signals from the idle switch, the top gear switch, the starter switch and the full-open switch. The output signal includes a pulse output signal for actuating the fuel pump 32 upon turn-on of the starter switch. The discrete input/output circuit 170 has a register (DDR) for deciding whether the terminals are to be used as input terminals for receiving states of the switches or output terminals for supplying the output to a latch which keeps the fuel pump 32 actuated, and a register (DOUT) for latching the output data.

A register (MOD) 160 registers instructions which instruct various states in the input/output circuit 108. For example, an instruction registered in the register 160 causes the AND gates 136, 140, 144 and 156 to be conditioned. By registering an appropriate instruction to the register 160, the start and stop of the output of the injector control circuit 134, the ignition pulse generating circuit 138 or the control circuit 142 can be controlled.

FIG. 4 shows a program system chart for the control circuit of FIG. 3. When a power is turned on by a key switch (not shown), the CPU 102 assumes a start mode and executes and initialize program (INITIALIZ) 204. Then, it executes a monitor program (MONIT) 206 and a background job (BACK GROUND JOB) 208. As the background job, it executes an exhaust gas recirculation quantity control task (EGR CON) and an aperture control task (ISC CON) for the bypass valve 62. If an interrupt request (IRQ) occurs during the execution of the task, an interrupt request analysis program (IRQ ANAL) 224 is executed from a step 222. The interrupt request analysis program 224 includes an end interrupt process program for the first analog-to-digital converter (ADCl END IRQ) 226, an end interrupt process program for the second analog-to-digital converter (ADC 2 END IRQ) 228, an interval interrupt request process program (INTV IRQ) 230 and an engine stall interrupt program (ENST IRQ) 232, and issues start requests (QUEUE) to the repsective tasks necessary to start the tasks to be described later.

The programs 226, 228 and 230 in the interrupt request analysis program 224 issue the start requests (QUEUE). The tasks which receive the start requests (QUEUE) are level 0 tasks 252, level 1 tasks 254, level 2 tasks 256 and level 3 tasks 258 which are levelled in the order of priority, or a task which constructs the respective tasks. The task which receives the start request (QUEUE) from the engine stall interrupt process program 232 is a process task (ENST TASK) 262 at the engine stall. When the process task 262 is executed, the control system again assumes the start mode and returns to the start mode 202.

A task scheduler 242 determines the execution order of the tasks such that the tasks which issue the start requests (QUEUE) or the execution interrupt tasks in the descending order of the level. (In the illustrated example, the level 0 is a hight level). When the execution of the tasks is completed, it is reported by an end report program (EXIT) 260. As a result, the highest level tasks of the queuing tasks are next executed.

When the execution interrupt tasks or the queuing tasks are no longer present, the execution of the CPU is again shifted to the background job 208 by the task scheduler 242. When the interrupt request is issued during the execution of any of the level 0 tasks to the level 3 tasks, the control system returns to the start point 222 of the interrupt request process program.

Table 1 shows start timings and functions of the respective tasks.

TABLE 1

| Level | Program Name | Function | Start Timing |
|---|---|---|---|
| — | IRQ ANAL | Analysis of interrupt request and issueance of start requests to a task or tasks | IRQ |

TABLE 1-continued

| Level | Program Name | Function | Start Timing |
|---|---|---|---|
| — | TASK SCHEDULER | Determination of execution task or tasks | End of IRQ ANAL or end of EXIT |
| — | EXIT | Report of end of execution tasks | End of task |
| 0 | AD1 IN | Read-in of output of ADC1 | INTV IRQ 10 m-sec. or ADC1 END |
| | AD1 ST | Start of ADC1 | INTV IRQ 10 m-sec. |
| | AD2 IN | Read-in of output of ADC2 | INTV IRQ 110 m-sec. or ADC2 END |
| | AD2 ST | Start of ADC2 | INTV IRQ 10 m-sec. |
| | RPMIN | Read-in of engine rotation speed | INTV IRQ 10 m-sec. |
| 1 | INJC | Calculation of amount of fuel injection | INTV IRQ 20 m-sec. |
| | IGNCAL | Calculation of ignition timing | INIV IRQ 20 m-sec. |
| | DWLCAL | Calculation of conduction start timing | INTV IRQ 20 m-sec. |
| 2 | LAMBDA | Control of input | INTV IRQ 20 m-sec. |
| 3 | HOSEI | Calculation of correction | INTV IRQ 40 m-sec. |
| — | ISC CON | Calculation of aperture of bypass valve 62 | Background job |
| — | EGR CON | Calculation of aperture of EGR vacuum control valve | Background job |
| — | INTLIZ | Initialization to input/output circuit | Start or restart |
| — | MONIT | Monitor of switches such as starter switch and start of fuel pump | Start or restart |
| — | ENST TASK | Stop of fuel pump and reset of ignition pulse generating circuit | ENST IRQ |

Figure 5:
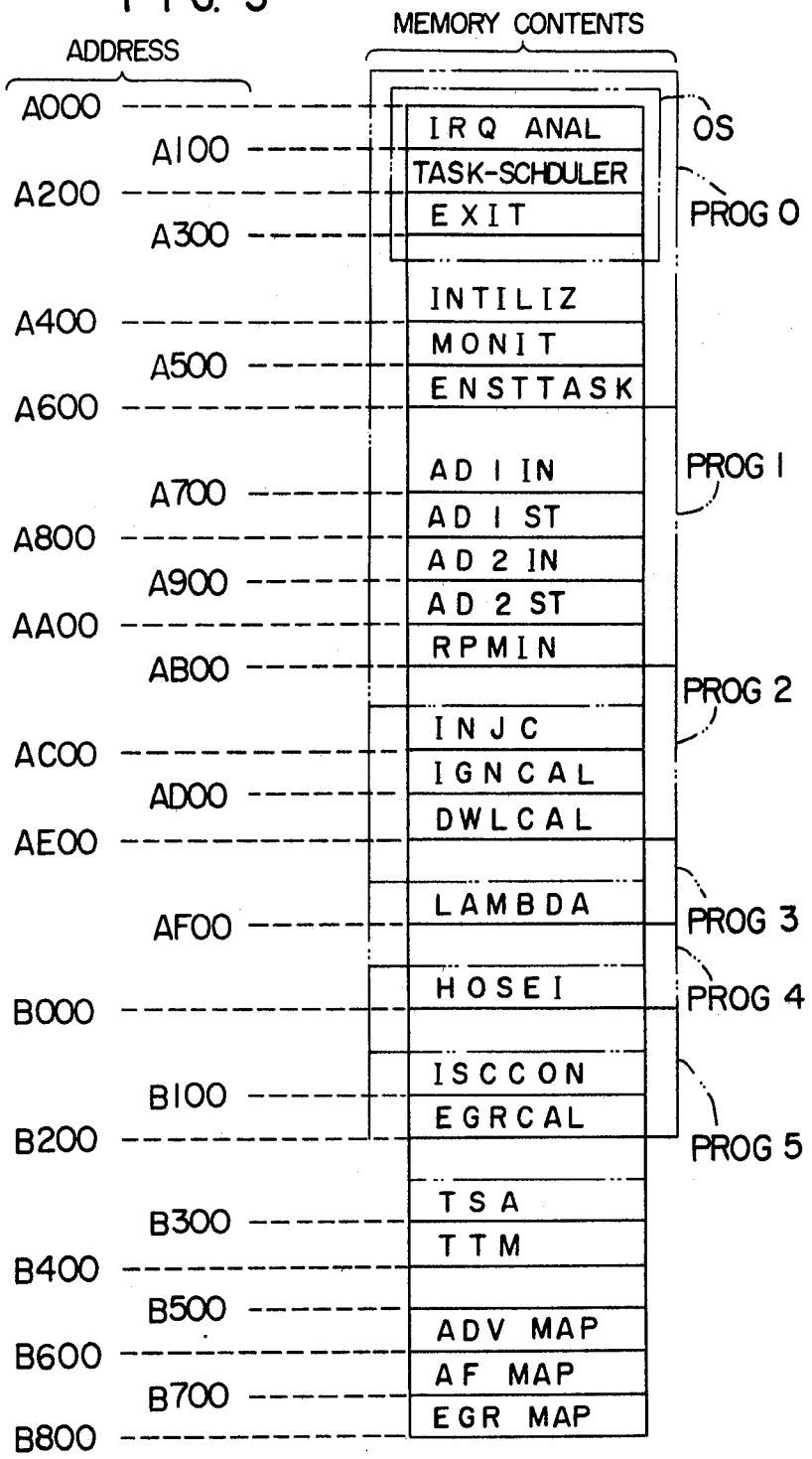
FIG. 5 shows a stored data format.

In the Table 1, the program for managing the control system of FIG. 4 includes the programs IRQ ANAL, TASK SCHEDULER and EXIT. Those programs (OS) are stored in the ROM 104 of FIG. 5 from address A000 to A300.

The level 0 program includes the programs AD1IN, AD1ST, AD2IN, AD2ST and RPMIN, which are usually started at every INTV IRQ 10 m-sec. The level 1 program includes the programs INJC, IGNCAL and DWLCAL, which are started at every INTV IRQ 20 m-sec. The level 2 program includes the program LAMBDA which is started at every INTV IRQ 40 m-sec. The level 3 program includes the program HOSEI which is started at every INTV IRQ 10 m-sec. The background job includes the programs EGR CON and ISC CON. The level 0 program is stored at PROG1 in the ROM 104 of FIG. 5 from address A600 to address AB00. The level 1 program is stored as PROG2 in the ROM 104 from address AB01 to AE00. The level 2 program is stored as PROG3 in the ROM 104 from address AE01 to AF00. The level 3 program is stored as PROG4 in the ROM 104 from address AF01 to address B000. The background job program is stored from address B001 to B200. A list of the start addresses from the programs PROG1 to PROG4 are stored from address B201 to B300, and start period data for the programs PROG1 to PROG4 are stored from address B301 to B400.

Other data are stored from address B401 to address B500 as required. In subsequent areas, data necessary for the calculations such as an ignition timing map (ADV MAP), an air to fuel ratio compensation map (AF MAP) and an exhaust gas recirculation map (EGR MAP) are stored.

Figure 6:
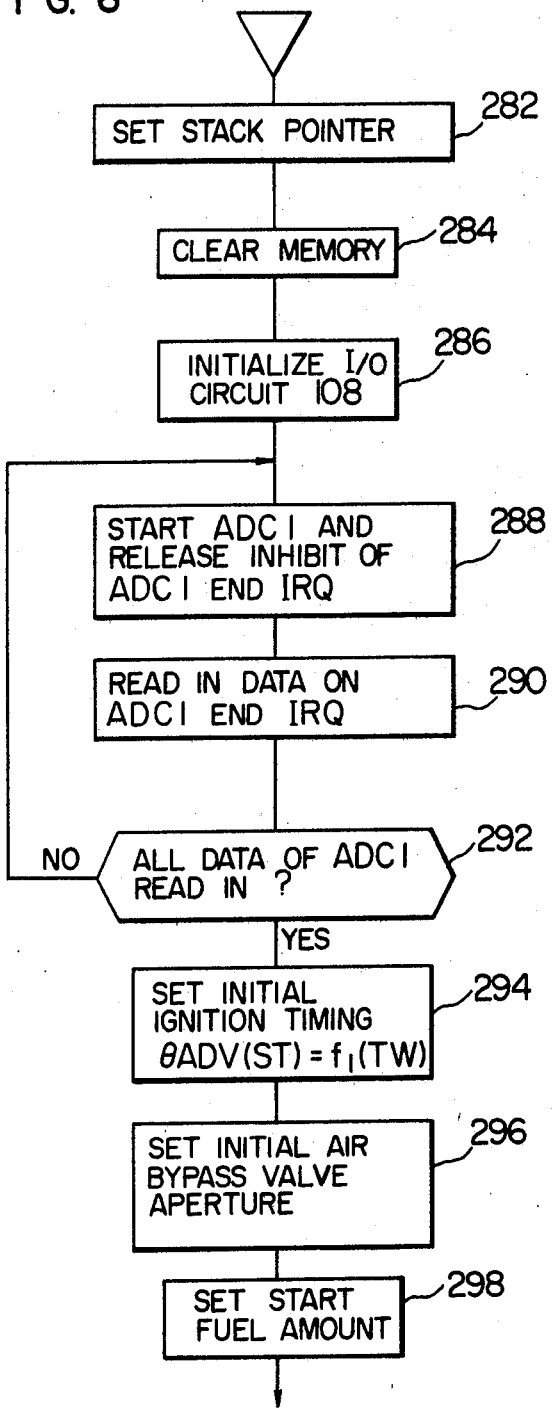
FIG. 6 shows a process flow chart.

Referring to FIG. 6, a detail of the program INITIALIZ 204 shown in FIG. 4 is explained. In a step 282, a save area for the address of the program which is being executed at the occurrence of the interrupt request is set. In a step 284, the RAM 106 is cleared. In a step 286, the registers in the input/output circuit 108 are initialized. The initialization includes initial setting of the number of cylinders of the engine, setting of an initial value of the angle sensor 146, setting of the register DDR of the discrete input/output circuit 170, setting of the timer for generating INTV IRQ and setting of measurement time for sensing the engine rotation speed.

In a step 288, the first analog-to-digital converter 122 is started and the inhibit for the end interrupt program for the first analog-to-digital converter 122 is released. The process jumps to an address A701 in FIG. 4 which is a start address of the program AD1ST. As a result, the output of the battery voltage sensor 132 which is one of the inputs to the multiplexor 120 of the first analog-to-digital converter 122 shown in FIG. 3 is selected out to the first analog-to-digital converter 122. As the operation of the first analog-to-digital converter 122 is completed and the digital value is set to the register 124, the completion of the first analog-to-digital converter is reported to the status register (STAT) and the end interrupt program for the first analog-to-digital computer is loaded to the CPU 102. Thus, in a step 290, the program AD1IN is executed and the output of the sensor 132 is sampled into the data area of the RAM 106. In a step, it is checked if all of the data from the sensors 132 to 118 have been sampled. In the present example, since only the data of the sensor 132 has been sampled, the process goes back to the step 288, in which the program AD1ST is again started and the multiplexor 120 selects out the next input, that is, the output of the sensor 56. In the step 290, in response to the report of the completion of the analog-to-digital conversion of the output of the sensor 56, the program AD1IN is executed and the digital value of the output of the water temperature sensor 56 stored in the register 124 is read out and stored in the data area of the RAM 106. In the step 292, the process again goes back to the step 288. Through the repetitive looping of the step 288 to the step 292, the digital values of the outputs of the sensors 132 to 118 are sequentially read in, and when the output of the λ sensor 118 is read in, the process goes to a step 294.

In the step 294, the ignition timing for the start operation is calculated and set. The ignition timing $\theta$ ADV (ST) is calculated as a function of the engine coolant temperature TW. This function is shown in FIG. 7. The ignition timing $\theta$ ADV (ST) is calculated in accordance with the characteristic shown in FIG. 7 and the calculated result is set in the register ADV of the ignition pulse generating circuit 138.

In a step 296, the aperture of the air bypass valve 62 for the start operation is calculated. The calculation is effected based on a characteristic shown in FIG. 8 and the calculated result is set in the register EGRD of th exhaust gas recirculation quantity control pulse generating circuit 154. A fixed value is set to the register EGRP. The characteristic of FIG. 8 shows a ratio of the setting of the register EGRP to the setting of the register EGRD.

In a step 298, an initial value of the fuel injection time period is calculated. The calculation is effected based on a characteristic shown in FIG. 9 and the calculated result is set in the register 134.

Thus, the process of the program INITIALIZ 204 is completed.

Then, the program MONIT 206 is started. In the program MONIT 206, the start condition is monitored to effect necessary steps. More specifically, the state of the starter switch 152 is checked and if it is on and the start condition is on the fuel pump 32 is actuated. A starter flag is set for a subsequent use.

Then, the program 208 which is shown in FIG. 10 is started. Referring to FIG. 10, in a step 410, the state of the idle switch 148 for sensing the idle condition is checked. If it is on, the exhaust gas recirculation is not effected and the process goes to a step 412, in which "0" is set to the register EGRD. In a step 414, the duty of the air bypass valve 62 is calculated based on the coolant temperature, and in a step 416 the calculated duty is set to the register ISCD. The amount of air bypass to the engine is determined by the setting of the register ISCD. As the step 416 is completed, the process goes back to the step 410 and the closed loop process is repeated unless the interrupt request to the CPU 102 is issued.

On the other hand, if the idle switch 148 is off, the control of the duty of the air bypass valve is not effected and "0" is set to the register ISCD in a step 418, and the exhaust gas recirculation quantity is calculated. In a step 420, the coolant temperature TW is compared with a predetermined temperature TA (°C.), and if it is higher than the temperature TA, the process goes to a step 424 in which the exhaust gas recirculation is cut off and "0" is set to the register EGRD. If the coolant temperature TW is lower than the predetermined temperature TA, the process goes to a step 422 and the coolant temperature is compared with a predetermined temperature TB, and if it is lower than the temperature TB the exhaust gas recirculation is cut off and the process goes to the step 424 to set "0" to the register EGRD. The temperature TA in the step 420 is an upper limit temperature and the temperature TB of the step 422 is a lower limit temperature. If the coolant temperature is within this range, the exhaust gas recirculation is started. Thus, the process goes to a step 426 in which the map is looked up based on the amount of intake air QA and the engine rotation speed N to calculate the exhaust gas recirculation quantity. The map is stored in the ROM 104 of FIG. 5 from the addresses B701 to B800. The looked-up value is set to the register EGRD in a step 428. As a result, the exhaust gas recirculation valve is opened at a duty factor determined by the ratio of the setting of the register EGRD and the setting of the register EGRP to effect the exhaust gas recirculation.

In the flow chart shown in FIG. 10, when the step 428 or 416 is completed, the process goes back to the step 410. Thus, the CPU 102 always follows the flow from the step 410 to the step 416 for controlling the air bypass valve 62 or the flow from the step 418 to the step 428 for controlling the exhaust gas recirculation quantity. Accordingly, unless the interrupt request is issued, the program started at the point 202 executes the program INITIALIZ 204 and the program MONIT 206 and continues to execute the program ISC CON or the program EGR CON in the background job 208.

The program MONIT 206 and the background job 208 can be interrupted by the interrupt request, and the execution of the program is resumed when the interrupt request program is completed.

The program ANAL 224 and the task scheduler 242 are not directly related to the present invention and hence the details thereof are omitted here. While two analog-to-digital converters are shown in FIG. 3, a similar function can be attained by a single analog-to-digital converter. The relation between the input/output device 108 and the CPU 102 may differ from that shown in FIG. 3 depending on the share of the hardwares and the share of the system but such a variation is within the scope of the present invention. In general, the relationship between the input/output device 108 and the status data of the automobile can be expressed by analog input, digital input, pulse input and analog output, digital output, pulse output. In this respect, the input/output device 108 may be varied in various systems.

The present invention has so far been explained in general. The present invention is now focused to a specific embodiment. The microcomputer reads in various status data and carries out necessary operations. In the present invention, the microprocessor reads in the intake air quantity Qa, the crank angle reference signal REF, the crank angle signal POS, the coolant temperature TW, and states of the idle switch 148 (corresponding to the throttle full-close switch) and the full-open switch 148A (corresponding to the throttle full-open switch). Those status data are used to determine the injector actuation time period $T_1$. The intake air quantity Qa is calculated based on the output of the hot wire sensor and hence the input data is the output of the hot wire sensor.

FIG. 11 shows a relationship between the reference signal REF and the injector actuation timing. The reference signal REF is generated by the crank angle reference signal sensor at every 180 degrees (corresponding to one-half revolution of the crank shaft). An injector actuation signal Si is generated in synchronism with the reference signal REF. The injector actuation signal Si has a period corresponding to one-half revolution of the crank shaft and has an open valve period Tp for each cycle. The open valve period Tp is given by $$Tp = K \cdot Qa/N \cdot f(Tw) \quad (1)$$

where N is the rotation speed, f (Tw) is a function of the coolant temperature Tw, and K is a constant. $Qa/N = T$ is called a basic injection quantity.

A relation between the hot wire sensor output V and the intake air quantity Qa follows a predetermined function. An exemplary characteristic is shown in FIG. 12. If the relation follows the illustrated characteristic, it is assumed that the sensor output V is theoretically valid over an entire range of level but it has been confirmed by the inventor of the present invention that the sensor output V is valid only in a certain range of level and the output V is unreliable when the level is below a minimum allowable level Vmin or above a maximum allowable level Vmax. When a level beyond the range between the levels Vmin and Vmax is sensed, it is considered that the sensor has some trouble in its performance.

Thus, in the present invention, when the sensor output is below Vmin or above Vmax, it is considered that trouble has occurred and the trouble is detected by monitoring the sensor output V. The control quantity to be supplied to the injector when the trouble is detected is determined by the aperture of the throttle. Relationships between the throttle full-open switch 148A and the throttle full-close switch 148, and the operation conditions of the engine, that is, the idling condition, the medium load condition and the full load condition are shown in Table 2.

TABLE 2

| Condition | Throttle Full-Close Switch | Throttle Full-Open Switch |
|---|---|---|
| Idling condition | ON | OFF |
| Medium Load Condition | OFF | OFF |
| Full Load Condition | OFF | ON |

As seen from Table 2, by the combination of the ON state and the OFF state of the throttle full-close switch and the throttle full-open switch, the load condition can be determined. Accordingly, when the hot wire sensor has troubles, the basic injection quantity T may be determined to comply with the load condition. FIG. 13 shows settings of the basic injection quantity T which are set to comply with the idling condition, the medium load condition and the full load condition. It is set to $T_1$ in the idling condition, $T_2$ in the medium load condition and $T_3$ in the full load condition. As a result, three steps of basic injection quantity are set for the respective load conditions and the injector control quantity Tp is calculated based on the formula (1) to control the injector. FIG. 14 shows a flow chart for the above operation.

In a step 900, the engine rotation speed N is read in. In a step 901, the output V of the hot wire sensor is read in. In a step 902, the intake air quantity Qa is calculated based on the output V. In a step 903, the coolant temperature Tw is read in. In a step 904, the sensor output V is compared with Vmax to determine if V is larger than Vmax, and if the decision is "NO", the sensor output V is compared with Vmin in a step 905 to determine if V is smaller than Vmin. If the decision is "NO", it is determined that the hot wire sensor operate normally and the open valve period Tp of the injector is calculated based on the formula (1) in a step 906.

If the decision in the step 904 or 905 is "YES", it is determined that the operation of the hot wire sensor is not normal and the following steps are carried out. In a step 907, it is checked if the throttle valve is fully closed, and if the decision is "YES" the open valve period $Tp=K\cdot T_1\cdot f(Tw)$ for the idling condition is calculated in a step 908. If the decision in the step 907 is "NO", it is checked if the throttle valve is fully opened in a step 909. If the decision is "NO", the open valve period $Tp=K\cdot T_2\cdot f(Tw)$ for the medium load condition is calculated in a step 910. If the decision in the step 909 is "YES", the open valve period $Tp=K\cdot T_3\cdot f(Tw)$ for the full load condition is calculated in a step 911. In a step 912, the signal representative of the open valve period calculated in the step 906, 908, 910 or 911 is supplied to the injector control circuit 134.

In the above embodiment, the open valve period Tp is calculated taking the coolant temperature Tw into consideration. Alternatively, it may be calculated by neglecting the coolant temperature Tw by the following formula.

$$Tp=K_1\cdot V/N+K_2 \quad (2)$$

where $K_1$ and $K_2$ are constants. An embodiment therefor is explained with reference to FIG. 15.

In a step 1000, the engine rotation speed N is read in. In a step 1001, the signal V from the hot wire sensor is read in. In a step 1002. the hot wire signal V is compared with Vmax shown in FIG. 2 to determine if V is larger than Vmin. If the decision in the step 1002 is "YES", the process goes to a step 1005. If the decision in the step 1002 is "NO", the hot wire sensor signal V is compared with Vmin shown in FIG. 2 to determine if V is smaller than Vmin in a step 1003. If the decision in the step 1003 is "YES", the process goes to the step 1005, and if the decision in the step 1003 is "NO", the open valve period is calculated in a step 1004 based on the formula $$T_p=K_1\cdot V/N+K_2.$$

In the step 1005, it is checked if the throttle valve 14 is fully closed, that is, if the full-open switch 148 is on, and if the decision is "YES" a predetermined open valve period $T_{p1}$ for the full-close state of the throttle valve 14 is selected as the fuel supply quantity $T_p$ in a step 1006. If the decision in the step 1005 is "NO", it is checked in a step 1007 if the throttle valve 14 is fully opened, that is, if the full-open switch 148A is on. If the decision in the step 1007 is "YES", a predetermined valve open period $T_{p3}$ for the full-open state of the throttle valve 14 is selected as the fuel supply quantity $T_p$ in a step 1008. If the decision in the step 1007 is "NO", it is determined in a step 1009 that the throttle valve 14 is open but not fully open and a predetermined open valve period $T_{02}$ is selected as the fuel supply quantity $T_p$. In a step 1010, the fuel injection process is carried out.

In the above embodiment, the internal combustion engine control apparatus for backing up the failure of the intake air sensor, by the software of the computer has been described. A hardware configuration which attains the same object is now explained with reference to FIG. 16, in which the like elements to those shown in FIG. 3 are designated by the like numerals and the explanation thereof is omitted.

In FIG. 16, numeral 311 denotes a drive coil for the fuel injection valve, numeral 312 denotes a driving power transistor, numeral 313 denotes an ignition coil, numeral 314 denotes an ignition power transistor, numerals 315 and 316 denote retriggerable one-shot multivibrators, numerals 317–320 denote NAND gates, numerals 321–323 denote NOR gates, numeral 324 denotes an inverter, numerals 325–327 denote analog switches, numeral 328 denotes a control transistor and numerals 329–333 denote resistors.

The drive coil 311 is energized by a current supplied from the transistor 312 which is driven by the fuel injection valve drive signal INJ generated by the input/output circuit 108 of the CPU 102, to intermittently open the fuel injection valve at a predetermined timing for a constant time period to take in the gas mixture to the cylinders of the engine.

The ignition coil 313 is energized by a current from the transistor 314 which is driven by the ignition signal IGN generated by the input/output circuit 108 of the CPU 102 so that an ignition high voltage HV is generated when the transistor 314 is turned off at the ignition timing to ignite the engine.

The operation of the present embodiment is now explained.

The CPU 102 reads in the data from the sensors through the input/output circuit 108 in accordance with the program stored in the ROM 104 of the CPU 102 and processes the data to generate the signals INJ and IGN from the input/output circuit 108 to control the engine.

On the other hand, the CPU 102 has a so-called watch dog timer function WDT so that a square wave signal c is generated from the input/output circuit 108 when the program of the CPU 102 is normal.

The signal c is applied to a trigger input terminal of the retriggerable one-shot multivibrator 315, which produces a signal d at a Q-output terminal thereof.

By selecting a time constant of the one-shot multivibrator 315 to be longer than the pulse duration of the signal c, the Q-output of the one-shot multivibrator 315 is kept "1" and does not assume "0" so long as the signl c is present.

As a result, the signal d is kept "1" when the program operation of the CPU 102 is normal and the signal d assumes "0" when the signal c interrupts for a period longer than the time constant of the one-shot multivibrator 315 by some reason such as the overrun of the program by a noise or the failure of the CPU 102. Accordingly, the abnormal operation of the CPU 102 can be detected by checking the signal d.

The signal d from the one-shot multivibrator 315 is applied to the NOR gate 323, which produces a signal a which, in turn, is "0" when the operation of the CPU 102 is normal and "1" when the operation of the CPU 102 is abnormal.

The signal a is applied directly to first input terminals of the NAND gates 318 and 320 and applied to first input terminals of the NAND gates 317 and 319 through the inverter 324. As a result, when the signal a is "0", that is, when the operation of the CPU 102 is normal, the signals INJ and IGN which are supplied to the other input terminals of the NAND gates 317 and 319, respectively, appear at the output terminals of the NOR gates 321 and 322, respectively, so that the drive coil 311 is energized by the signal INJ from the input/output circuit 108 to inject the fuel and the ignition coil 313 generates the bigh voltage HV by the signal IGN supplied from the input/output circuit 108 to ignite the engine.

If the CPU 102 fails or the program overruns and the signal a changes to "1", the NAND gates 317 and 319, which have heretofore been open, now close and the NAND gates 318 and 320 in turn open. Under this condition, the signals b and REF which are supplied to the other input terminals of the NAND gates 318 and 320, respectively, appear at the output terminals of the NOR gates 321 and 322, respectively. Accordingly, the drive coil 311 is energized by the signal b at the Q-output terminal of the one-shot multivibrator 316 (which may be a retriggerable multivibrator) to drive the fuel injection valve and the ignition coil 313 is energized by the signal REF to generate the high voltage HV.

The CPU 102 has an additional function to monitor the data from the sensors necessary for the control, for example, the data V from the hot wire sensor 24 and produce a signal e which is "1" so long as the data are normal.

Accordingly, if the hot wire sensor 24 fails and the data V assumes an abnormal value or disappears, the signal e assumes "0". Under this condition, the signal a at the output terminal of the NOR gate 323 assumes "1" so that the control signal to the drive coil 311 is changed from the signal INJ supplied from the input/output circuit 108 to the signal b supplied from the one-shot multivibrator 316 and the ignition signal to the ignition coil 313 is changed from the signal IGN supplied from the input/output circuit 108 to the signal REF to continue the control to the engine.

As a result, in the present embodiment, when the CPU 102 or the sensors fail, the drive coil 311 and the ignition coil 313 are back-up controlled by the signal REF from the angle sensor 146 in place of the signals INJ and IGN from the input/output circuit 108. Thus, even if the signal INJ or IGN is abnormal or disappears by the failure of the CPU 102 or the sensors, the engine control is continued to prevent the engine stall.

The control of the drive coil 311 of the fuel injection valve and the control of the ignition coil 313 by the signal REF in the back-up control mode are now explained.

The control of the drive coil 311 is first explained. The signal REF is a square wave signal which is generated, for example, at every 180 degrees of the crank angle for a four-cylinder engine, as shown in FIG. 17 (*a*).

When the signal REF is supplied to the trigger input terminal of the one-shot multivibrator 316, it is triggered at a rising edge of the signal REF and produces the signal b of the pulse duration determined by the time constant thereof at the Q-output terminal.

The one-shot multivibrator 316 has three resistors 329, 330 and 331 for determining the time constant. Those resistors are selected by analog switches 325, 326 and 327, respectively, and have resistances R29, R30 and R31 which meet the following relation.

$$R29 < R30 < R31$$

The analog switches 325–327 may be electronic switches which are turned on when control inputs thereto are "1", respectively. The signal IDLE from the idle switch 148 is applied to the control input terminal of the switch 325 and the signal FULL from the full-open switch 148A is applied to the control input terminal of the switch 327. Accordingly, when the acceleration pedal is not stepped in, the switch 325 is turned on, and when the acceleration pedal is fully stepped in the switch 327 is turned on. On the other hand, a collection voltage of the transistor 328 is applied to the control input terminal of the switch 326 so that the switch 326 is turned on when the transistor 328 is off. Since a base of the transistor 328 is connected to the output terminals of the idle switch 148 and the full-open switch 148A through resistors 332 and 333, respectively, the transistor 328 is turned off when both the signal IDLE and the signal FULL are "0". Consequently, the switch 326 is turned on only when the acceleration pedal is stepped in from the idle position but not fully stepped in to the full-open position.

As a result, the time constant of the one-shot multivibrator 316 changes in three steps in accordance with the aperture of the throttle valve. It is set to a relatively small time constant determined by the resistor 329 at the idling aperture, set to a relatively large time constant determined by the resistor 331 at the full throttle aperture, and set to an intermediate time constant determined by the resistor 330 at an intermediate aperture between the idling aperture and the full throttle aperture. Accordingly, the signal b at the Q-output terminal of the one-shot multivibrator 316 changes as shown in FIGS. 17(*b*)–(*d*). At the idling aperture, the signal b has a pulse duration A shown in FIG. 17(*b*), at the full throttle aperture it has a pulse duration C shown in FIG. 17(*d*) and at the intermediate aperture it has a pulse duration B shown in FIG. 17(*c*). The drive coil 311 is controlled by the signal b.

In the present embodiment, the fuel injection quantity in the back-up control mode is not controlled to a substantially constant quantity in accordance with the crank angle by the signal REF but changed in accordance with the throttle valve aperture. Accordingly, the air to fuel ratio of the engine can be maintained at a proper value in the back-up control mode.

As shown in FIG. 18(*a*), the square wave signal REF rises 70 degrees before the top and bottom dead center and falls 10 degrees before the top and bottom dead center. When the signal REF is supplied to the transistor 14 in the back-up control mode, a current waveform flowing through a primary winding of the ignition coil 313 changes as shown in FIG. 18(*b*). Thus, it is seen that a sufficient conduction period is provided by controlling the ignition coil 313 by the signal REF to rise a primary current of the ignition coil 313 to ignite the engine so that the engine stall is prevented.

In the present embodiment, the ignition timing is fixed to 10 degrees before the top dead center but it is sufficient for the purpose of the back-up control.

Accordingly, by the use of a device such as a photocoupler which generates the signal REF having a relatively wide pulse duration as shown in FIG. 18(*a*), the sufficient back-up control is attained. In the normal electronic engine control operation by the CPU 102, only the rising edge of the signal REF is used as the timing signal. Accordingly, the widening of the pulse duration of the signal REF as shown in FIG. 18(*a*) in accordance with the present invention does not affect to the normal operation.

The present embodiment can be implemented without using a crank angle sensor of a special specification which results in the signal REF as shown in FIG. 18(*a*) and such an embodiment is sufficient for practical use.

According to the present embodiment, when the hot wire sensor or other sensor fails, the basic injection quantity T depends on the throttle switch so that the operation is controlled in accordance with the load condition. When the present embodiment is not used, the air to fuel ratio is too lean or too rich and the engine stalls. The present embodiment overcomes such a problem and enables the control of the operation in accordance with the load condition.

By using the idle switch 148 as the throttle full-close switch and the full-open switch 148A as the throttle full-open switch, the number of switches can be reduced. If an aperture sensor which continuously senses the throttle aperture, is used the operation can be continuously controlled in accordance with the load condition. A vacuum sensor may be used for that purpose. The fuel supply can be controlled in accordance with the throttle aperture even if the CPU 102 fails. Furthermore, according to the present invention, the ignition timing can be set to a predetermined safe point when the CPU or the sensors fail.

What is claimed is:

1. An internal combustion engine control apparatus comprising:

sensors including first sensor means for sensing analog operation parameters of an internal combustion engine and second sensor means for sensing digital operation parameters of said internal combustion engine;

a control unit for generating at least one control signal to control the operation of said internal combustion engine based on said operation parameters sensed by said sensors;

a control circuit for controlling the operation of said internal combustion engine by said control signal;

means for detecting failure of at least one of said first sensor means and said control unit; and signal generating means responsive to the detection of the failure by said failure detection means for generating one of a plurality of predetermined signals indicating a predetermined operation condition in accordance with the signals sensed by said second sensor means and supplying said one predetermined signal to said control circuit, wherein said second sensor means includes an idle switch and a full-open switch, wherein said control unit includes a fuel injection controller and said control circuit includes a fuel injection control circuit, and wherein said signal generating means generates one of three predetermined signals corresponding to three states derived from combinations of the output of said idle switch and the output of said full-open switch in accordance with the combination of the outputs of said idle switch and said full-open switch.

2. An internal combustion engine control apparatus according to claim 1 wherein said first sensor means includes an intake air quantity sensor.

3. An internal combustion engine control apparatus according to claim 2 wherein said intake air quantity sensor is a hot wire sensor.

4. An internal combustion engine control apparatus according to claim 1 wherein said failure detection means detects the failure when the signal sensed by said first sensor means is beyond a predetermined effective output range of said first sensor means in a normal state thereof.

5. An internal combustion engine control apparatus according to claim 4 wherein said effective output rangis between a predetermined upper limit and a predetermined lower limit, and said failure detection means detects the failure when the signal sensed by said first sensor means is larger than said upper limit or smaller than said lower limit.

6. An internal combustion engine control apparatus according to claim 1 wherein said failure detection means includes a watch dog time in said control unit and a retriggerable one-shot multivibrator adapted to be triggered by a pulse from said watch dog timer and having a longer time constant than a period of said pulse in a normal state.

7. An internal combustion engine control apparatus according to claim 1 wherein said signal generating means includes a one-shot multivibrator, a time constant of said one-shot multivibrator being changed in accordance with the combination of the outputs of said idle switch and said full-open switch.

8. An internal combustion engine control apparatus according to claim 1 or 7 wherein said sensors include an angle sensor for sensing a crank shaft angle and said predetermined signal is supplied to said control circuit based on a reference crank angle derived from a signal sensed by said angle sensor.

9. An internal combustion engine control apparatus according to claim 8 wherein said control unit further includes an ignition timing controller and said control circuit includes an ignition timing control circuit, said ignition timing control circuit being provided with an ignition timing signal at said reference crank angle when said failure detection means detects the failure.

10. An internal combustion engine control apparatus according to claim 1 wherein said full-open switch comprises means for providing a full-open output signal when a throttle valve coupled to said internal combustion engine is in a fully open position.

11. An internal combustion engine control apparatus according to claim 10 wherein said full-open switch includes means for providing said full-open output signal at a point of throttle valve opening slightly less than said fully open position.

12. An internal combustion engine control apparatus according to claim 1 wherein said idle switch comprises means for providing a full-close output signal when a throttle valve coupled to said internal combustion engine is in a fully closed position.

13. An internal combustion engine control apparatus according to claim 12 whein said idle switch includes means for providing said full-close output signal at a point of throttle valve opening slightly prior to said throttle valve reaching said fully closed position.

* * * * *